United States Patent [19]

Hell et al.

[11] Patent Number: 4,727,933

[45] Date of Patent: Mar. 1, 1988

[54] DEVICE FOR COOLING HOT, DUST-LADEN GASES

[75] Inventors: Eckhard Hell, Oberhausen; Manfred Förster, Essen, both of Fed. Rep. of Germany

[73] Assignee: Deutsche Babcock Werke Aktiengesellschaft, Oberhausen, Fed. Rep. of Germany

[21] Appl. No.: 903,462

[22] Filed: Sep. 3, 1986

[30] Foreign Application Priority Data

Oct. 30, 1985 [DE] Fed. Rep. of Germany ..... 3538515

[51] Int. Cl.[4] ..... F22B 37/24

[52] U.S. Cl. ..... 165/82; 165/162; 122/510

[58] Field of Search ..... 165/82, 162; 122/32, 122/34, 510, 511

[56] References Cited

U.S. PATENT DOCUMENTS

| | | | |
|---|---|---|---|
| 1,818,446 | 8/1931 | Armacost | 165/162 X |
| 2,033,077 | 3/1936 | Kerr et al. | 165/162 |
| 3,060,909 | 10/1962 | Ott | 165/162 |
| 3,180,406 | 4/1965 | Oechslin | 165/162 X |
| 3,393,665 | 7/1968 | Jochtern | 122/510 |
| 3,850,235 | 11/1974 | Beckmann | 165/162 |
| 3,937,277 | 2/1976 | Krolmann et al. | 165/162 |
| 3,967,677 | 7/1976 | Mohlman | 165/162 |
| 4,187,902 | 2/1980 | Miller, Jr. et al. | 165/162 X |
| 4,466,384 | 8/1984 | Maurer et al. | 122/510 X |
| 4,624,304 | 11/1986 | Hayes | 165/162 |

*Primary Examiner*—Albert W. Davis, Jr.
*Assistant Examiner*—Richard R. Cole
*Attorney, Agent, or Firm*—Max Fogiel

[57] ABSTRACT

A device for cooling hot, compressed, dust-laden gases. The device consists of an inner structure made out of cooled tubes, positioned inside a pressurized container. The device contains several straight partitions made out of tubes. The partitions parallel the longitudinal axis of the inner structure. The object is to redesign the heat-emitting surfaces of the device in order to make it more compact. At least one of the straight partitions is bent out into a nest of tubes. The nest extends through the cross-section of the inner structure. The tubes that the nest is made out of extend through and are supported by the rest of the partitions.

7 Claims, 5 Drawing Figures

DEVICE FOR COOLING HOT, DUST-LADEN GASES

BACKGROUND OF THE INVENTION

The present invention relates to a device for cooling hot, compressed, dust-laden gases and consisting of an inner structure made out of cooled tubes, positioned inside a pressurized container, and containing several straight partitions made out of tubes and paralleling the longitudinal axis of the inner structure.

A device of this type in the form of a radiator is known from German OS No. 3 208 421. It is employed to cool gases deriving from a gasification reactor. The straight partitions intensively cool the gases. The radiator in the known device communicates with a separate downstream convection cooler with nested heat-emitting surfaces.

SUMMARY OF THE INVENTION

The object of the present invention is to redesign the heat-emitting surfaces of the aforesaid generic device in order to make it more compact.

This object is attained in a device of the aforesaid generic type in accordance with the invention wherein at least one of the straight partitions is bent out into a nest of tubes, the nest extends through the cross-section of the inner structure, and the tubes that the nest is made out of extend through and are supported by the rest of the partitions.

Individual tubes can be bent out of the plane of the partitions to create lanes for the tubes in the nest to extend through. The middle tube of every set of three tubes in one partition can be bent out of the plane of the partition.

The tubes on each side of a lane can function as supports and can be connected by webs for the tubes in the nest to extend through.

The middle partition can be bent into a nest and the tubes that belong to each adjacent partition and that remain within the plane of the partition can function as supports.

One or more additional nests provided with collectors can be positioned in the inner structure extending through and supported by the straight partitions, with the collectors secured by the bent-out tubes in the middle partition.

Some preferred embodiments of the invention will now be described with reference to the attached drawings, wherein

DETAILED DESCRIPTION OF THE PREFERRED EMBODIMENTS

Figure 1:
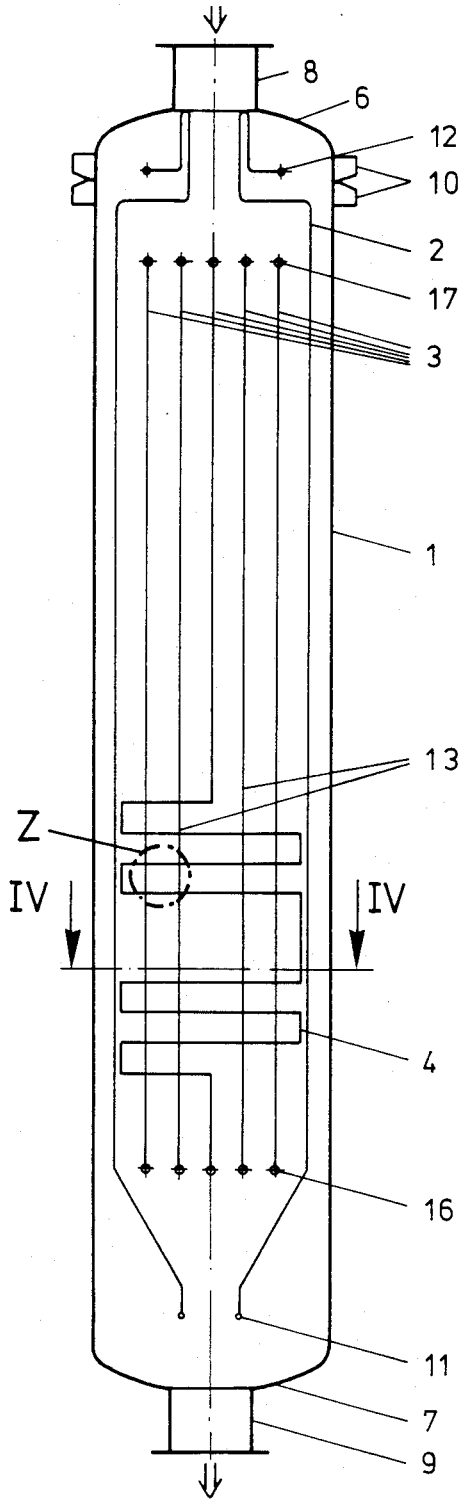
FIG. 1 is a schematic longitudinal section through a device in accordance with the invention.

A cooler is employed to cool hot, compressed, dust-laden gases, especially those deriving from a gasification reactor. The cooler consists essentially of two components, a shell and a core. The shell is an upright pressurized container 1 strong enough to accommodate gas pressures of 20 to 25 bars for example. The core comprises an inner structure 2, straight partitions 3, at least one nest 4 of tubes, and possibly one or more additional nests 5.

Pressurized container 1 consists of several annular sections welded together. Each end is closed off with a cover 6 and 7. Upper cover 6 has a gas-intake connection 8 and bottom cover 7 a gas-outlet connection 9. The top of pressurized container 1 is provided with a flanged, screwed-down connection 10 to facilitate opening and closing. The container can be secure in a frame by means of claws.

Inner structure 2 is positioned inside pressurized container 1 with a space between them and communicates with gas-intake connection 8. The gas that is to be cooled flows through inner structure 2 longitudinally. Since the outlet end of inner structure 2 is open, the gas pressure inside it will equal that in the space between it and pressurized container 1.

Inner structure 2 is made out of welded-together, cooled tubes that communicate with an intake collector 11 at the bottom and with an outlet collector 12 at the top. Gas flows through the tubes in inner structure 2 from the bottom to the top, and the structure is connected up to function as an evaporator.

Partitions 3 are positioned inside inner structure 2, extending parallel to each other along pressurized container 1. The tubes 13 and 14 in partitions 3 are fastened together by iron straps, and each communicates with an intake collector 16 and an outlet collector 17. The lines into the intake collector 11 on inner structure 2 and into the intake collectors 16 on partitions 3 extend through the space between inner structure 2 and pressurized container 1. Gas flows, as through the tubes in inner structure 2, through partitions 3 from the bottom to the top, and the partitions are also connected up to function as evaporators.

Figure 2:
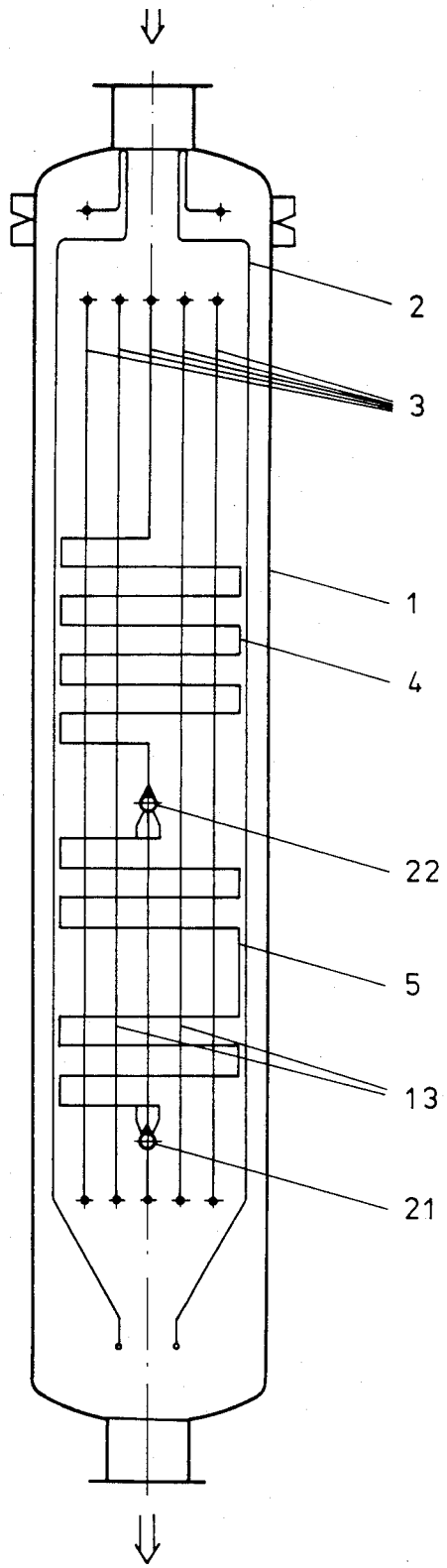
FIGS. 2 and 3 are longitudinal sections through another embodiment of the invention.

The tubes in at least one of partitions 3, preferably the middle partition, are bent into a nest 4 of tubes that extends in several coils through the cross-section of inner structure 2. Although the nest 4 illustrated in FIGS. 1 and 2 is represented as single-channeled for the sake of simplicity, it can also be multichanneled. Nest 4 is also connected up to function as an evaporator.

Figure 4:
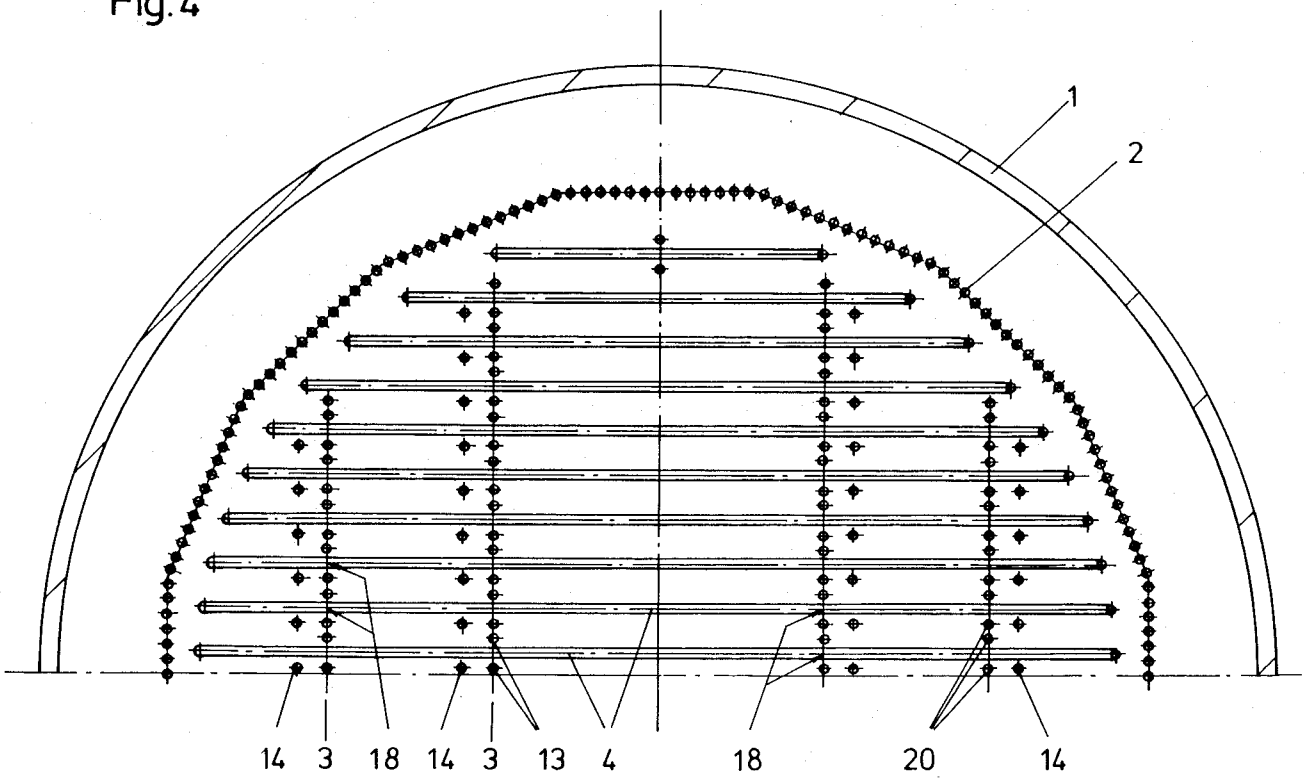
FIG. 4 is a section along the line IV—IV in FIG. 1.
Figure 5:
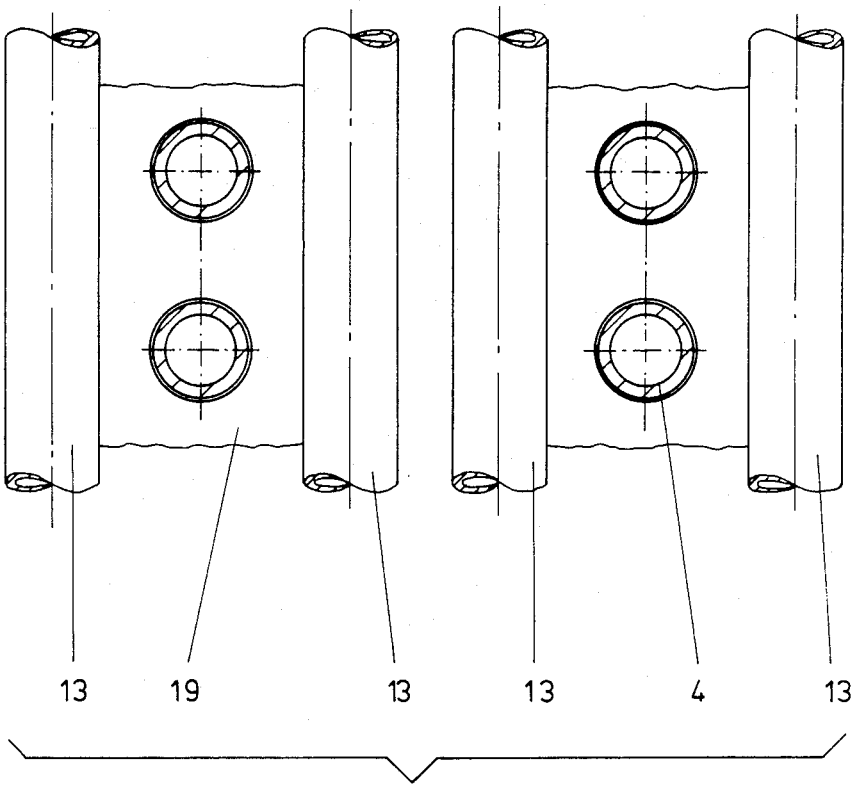
FIG. 5 is a detail of the area Z in FIG. 1.

One tube 14 out of three in the vicinity of the partitions 3 that are not bent out is bent of the plane of the partition (FIG. 4), creating lanes 18 inside partitions 3. The tubes in nest 4 extend through lanes 18. The tubes 13 on each side of lanes 18 in the partitions 3 immediately adjacent to the middle partition are fastened together with webs 19 (FIG. 5). The tubes in nest 4 extend through and are supported by webs 19. The tubes can also be reinforced with welded-on sleeves where they extend through the webs. The tubes 13 that remain within the plane of the partitions 3 on each side of the middle partition accordingly also function as supports, whereas the tubes 14 in these partitions and the tubes 20 in the other partitions are left free.

One or more additional nests 5 of tubes can, as illustrated in FIG. 2, be positioned inside inner structure 2. Nests 5 can be connected to function as superheaters, feed-water preheaters, or supplementary evaporators. Nests 5, like nest 4, extend through and are supported by partitions 3. Each nest 5 communicates with an intake collector 21 and an outlet collector 22. The tubes in the middle partition are bent out alternatingly left and right in the vicinity of collectors 21 and 22 and secure them.

Figure 3:
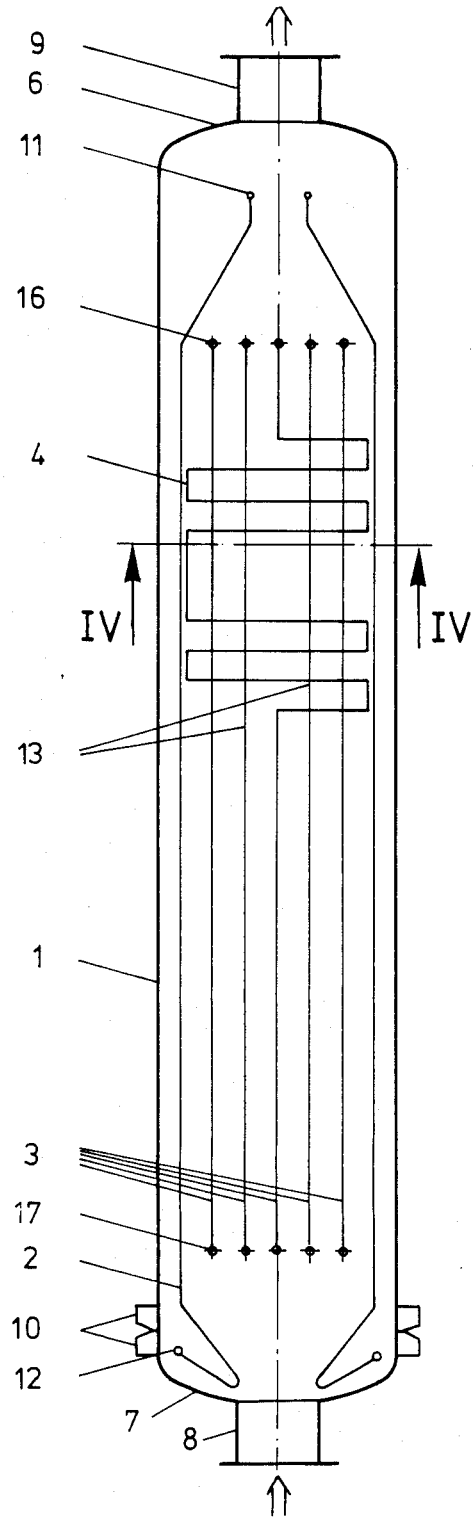

The cooler illustrated in FIG. 3 has a gas-intake connection 8 that communicates with bottom cover 7 and a gas-outlet connection that communicates with upper cover 6. Nest 4 is positioned within the top of inner structure 2. Otherwise the cooler is identical with that illustrated in FIG. 1. The encrustations eliminated from partitions 3 can easily be removed from a cooler of this type.

The invention has been described herein with reference to exemplary embodiments. It will be understood, however, that it is receptable of various modifications, which will offer themselves to those skilled in the art and which are intended to be encompassed within the protection sought for the invention as set forth in the appended claims.

What is claimed is:

1. Apparatus for cooling hot, compressed, dust-laden gases, comprising: a gas-tight housing; an inner structure of cooled tubes located within said housing; said housing being pressurized; a plurality of straight planar tube partitions with tubes in said structure and parallel to a longitudinal axis of said structure; said planar partitions comprising heating surfaces in the form of webs; at least one of said tube partitions having substantially horizontal pipe sections bent out into a nest of tubes extending over the cross-section of said inner structure through the other partitions, said nest of tubes being supported by the remaining unbent tube partitions, part of vertical planar tube partitions comprising simultaneously heating surfaces and a support means, the remaining part of vertical planar tube partitions comprising a substantially horizontally-lying nest of tubes, said support means, vertical heating surfaces and horizontal heating surfaces being all formed from a single tube system.

2. Apparatus as defined in claim 1, wherein individual tubes are bent out of planes of said partitions to form lanes, said nest of tubes extending through said lanes.

3. Apparatus as defined in claim 2. wherein every set of three tubes in one partition has a middle tube bent out of a plane of the respective partition.

4. Apparatus as defined in claim 3, including webs connecting tubes on each side of a lane, tubes on each side of a lane comprising support means, said nest of tubes extending through said webs.

5. Apparatus as defined in claim 3, wherein a middle partition is bent into a nest, tubes associated with each adjacent partition and remaining within a plane of the partition comprising support means.

6. Apparatus as defined in claim 3, wherein at least one nest has collector means located in said inner structure and extend through said straight partitions while being supported by said straight partitions, said collector means being secured by said bent-out tubes in a middle partition.

7. Apparatus for cooling hot, compressed, dust-laden gases, comprising: a gas-tight housing; an inner structure of cooled tubes located within said housing; said housing being pressurized; a plurality of straight planar tube partitions with tubes in said structure and parallel to a longitudinal axis of said structure; said planar partitions comprising heating surfaces in the form of webs; at least one of said tube partitions having substantially horizontal pipe sections bent out into a nest of tubes extending over the cross-section of said inner structure through the other partitions, said nest of tubes being supported by the remaining unbent tube partitions, part of vertical planar tube partitions comprising simultaneously heating surfaces and a support means, the remaining part of vertical planar tube partitions comprising a substantially horizontally-lying nest of tubes, said support means, vertical heating surfaces and horizontal heating surfaces being all formed from a single tube system; individual tubes being bent out of planes of said partitions to form lanes, said nest of tubes extending through said lanes; every set of three tubes in one partition having a middle tube bent out of a plane of the respective partition; webs connecting tubes on each side of a lane, tubes on each side of a lane comprising support means, said nest of tubes extending through said webs; a middle partition bent into a nest, tubes associated with each adjacent partition and remaining within a plane of the partition comprising support means; at least one nest having collector means located in said inner structure and extending through said straight partitions while being supported by said straight partitions, said collector means being secured by said bent-out tubes in a middle partition.

* * * * *